US007892044B2

(12) United States Patent
Wang et al.

(10) Patent No.: US 7,892,044 B2
(45) Date of Patent: Feb. 22, 2011

(54) TERMINAL MODULE FOR ELECTRICAL CONNECTOR

(75) Inventors: Chang-Yin Wang, Kunshan (CN); Chin-Te Lai, Tu-Cheng (TW); Su-Feng Liu, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 73 days.

(21) Appl. No.: 12/317,829

(22) Filed: Dec. 29, 2008

(65) Prior Publication Data

US 2009/0170363 A1 Jul. 2, 2009

(30) Foreign Application Priority Data

Dec. 29, 2007 (CN) ..... 2007 2 0129815 U

(51) Int. Cl.
*H01R 13/502* (2006.01)

(52) U.S. Cl. ..... 439/695; 439/106

(58) Field of Classification Search ..... 439/695, 439/106, 606

See application file for complete search history.

(56) References Cited

U.S. PATENT DOCUMENTS 4,790,776 A * 12/1988 Iijima ..... 439/695
5,474,459 A * 12/1995 Su ..... 439/106
6,802,741 B1 * 10/2004 Shatkin ..... 439/620.21
7,553,171 B2 * 6/2009 Wang et al. ..... 439/106

FOREIGN PATENT DOCUMENTS

CN 2560115 7/2003

* cited by examiner

*Primary Examiner*—Xuong M Chung Trans
(74) *Attorney, Agent, or Firm*—Wei Te Chung; Andrew C. Cheng; Ming Chieh Chang

(57) ABSTRACT

A terminal module includes at least two terminals (2, 3) for transmitting electrical power, each terminal having a retention portion (21) defining two positioning cavities therein, a mating portion (25) extending forward from the retention portion and a tail portion (23) extending rearward from the retention portion; and an insulative main portion (1) including a base portion (11) and two retaining portions (12) laterally extending outward from the base portion, each retaining portion having two locking arm portions (121) spaced apart from one another and locked into the two positioning cavities of the retention portion of the corresponding terminal.

14 Claims, 4 Drawing Sheets

TERMINAL MODULE FOR ELECTRICAL CONNECTOR

FIELD OF THE INVENTION

The present invention generally relates to a terminal module, and more particularly to an improved terminal module for an electrical connector.

DESCRIPTION OF PRIOR ART

More and more household appliance products are adopted in recent years and many of those products are powered by electricity. Electrical connectors are widely used for connecting those electrical devices and power outlets. Usually, there are two types of electrical connectors, one kind of the connector has two poles, and the other kind has three poles. CN Pat. No. 2560115 discloses an electrical connector for power transmitting, and the electrical connector has a terminal module which includes an inner frame and two terminals combined with the inner frame. However, a structure of the frame is much more complicated and has some difficulty in manufacturing and assembling processing.

Hence, an improved terminal module is highly desired to overcome the aforementioned problems.

SUMMARY OF THE INVENTION

Accordingly, an object of the present invention is to provide an improved terminal module for an electrical connector.

In order to achieve the object set forth, a terminal module in accordance with the present invention comprises at least two terminals for transmitting electrical power, each terminal having a retention portion defining two positioning cavities therein, a mating portion extending forward from the retention portion and a tail portion extending rearward from the retention portion; and an insulative main portion including a base portion and two retaining portions laterally extending outward from the base portion, each retaining portion having two locking arm portions spaced apart from one another and locked into the two positioning cavities of the retention portion of the corresponding terminal.

Other objects, advantages and novel features of the invention will become more apparent from the following detailed description when taken in conjunction with the accompanying drawings.

DETAILED DESCRIPTION OF PREFERRED EMBODIMENTS

Figure 1:
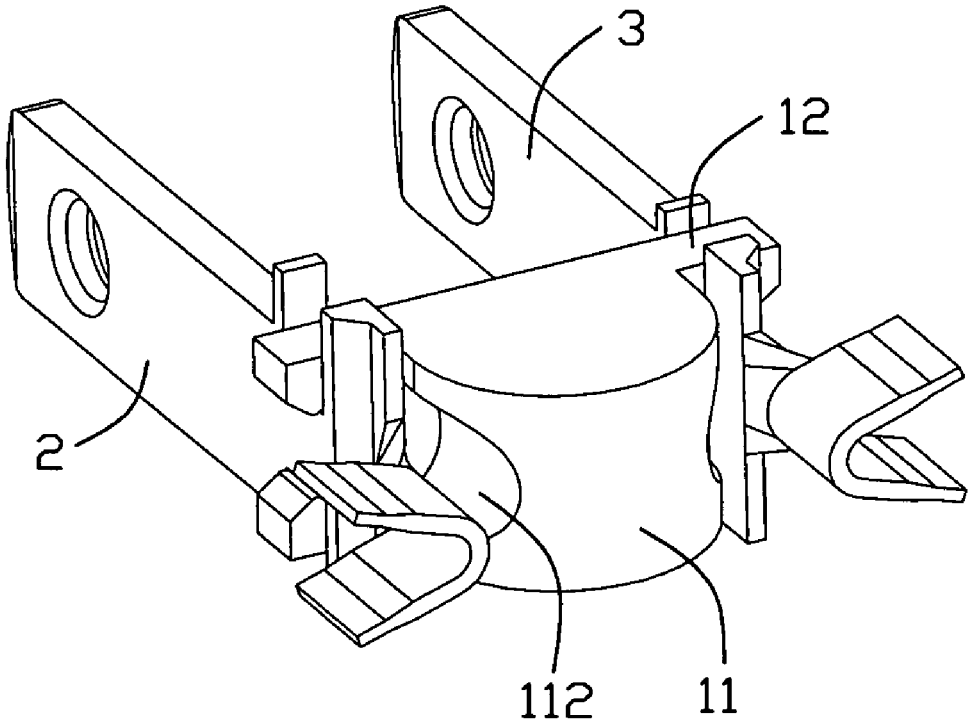
FIG. 1 is an assembled, perspective view of a terminal module.
Figure 2:
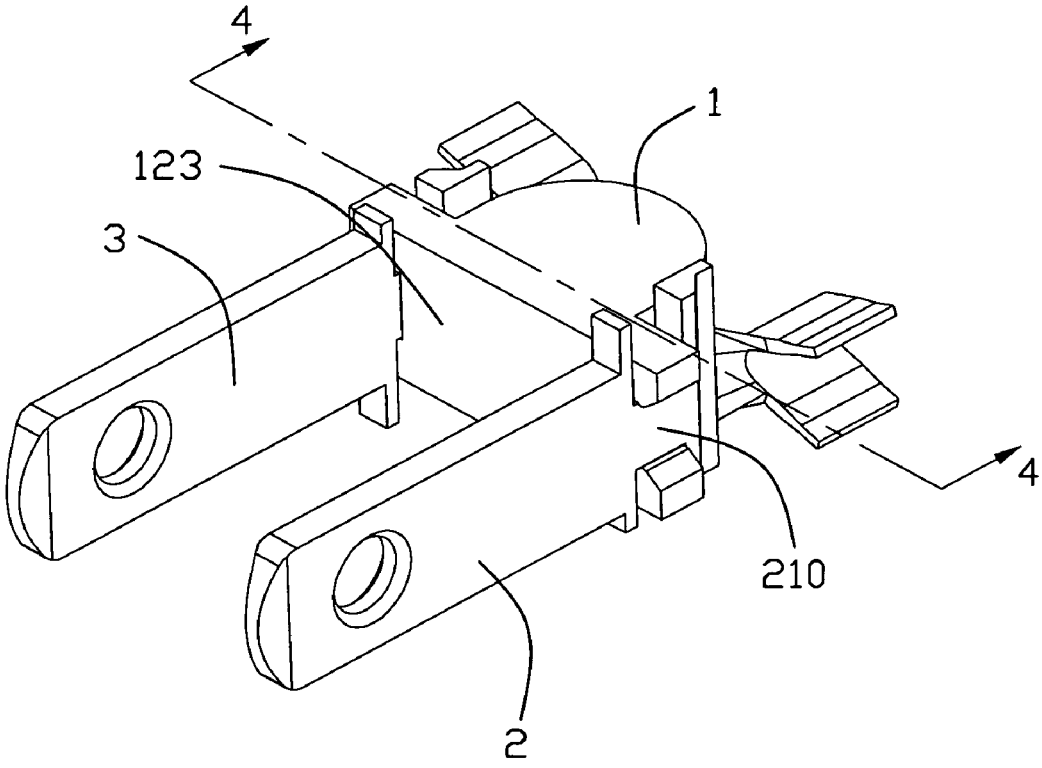
FIG. 2 is similar to FIG. 1, but viewed from another aspect.
Figure 3:
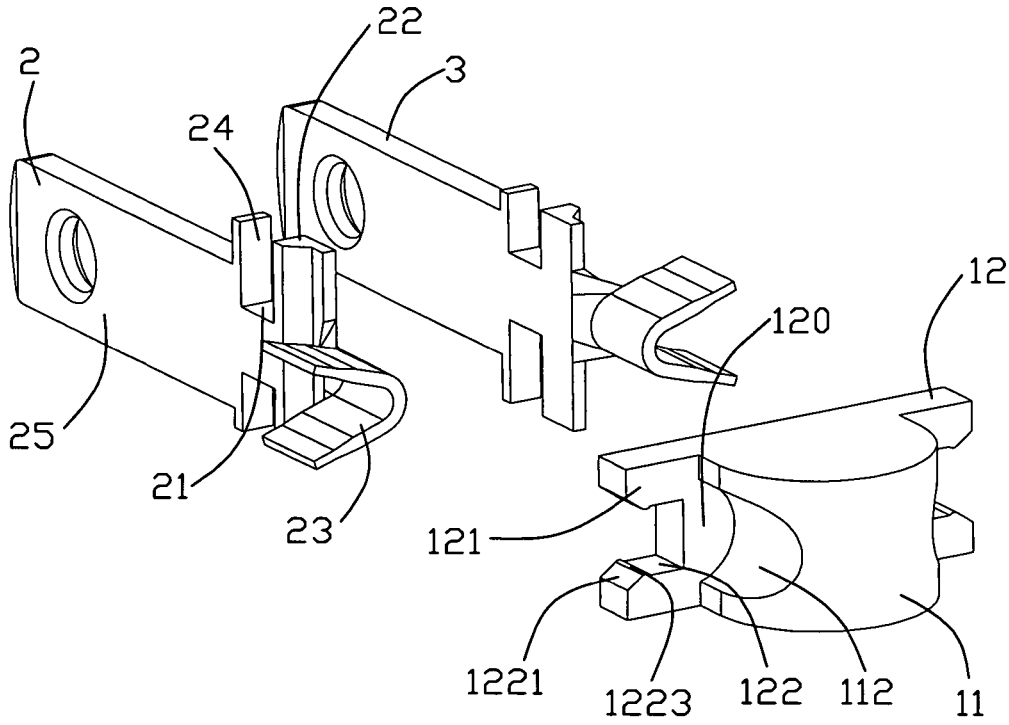
FIG. 3 is an exploded, perspective view the terminal module.

Reference will now be made in detail to the preferred embodiment of the present invention.

Referring to FIGS. 1-4, a terminal module for an electrical connector comprising an insulated main portion 1, a first terminal 2 for transmitting positive power and a second terminal 3 for transmitting negative power. The first terminal 2 and the second terminal 3 are securely mounted to the main portion 1.

The main portion 1 includes a base portion 11 and two retaining portions 12 extending outward from front segments of lateral sides of the base portion 11, respectively. Each retaining portion 12 has a vertical wall 120 and two locking arm portions 121 extending outward from an up and a low portions of the vertical wall 120. An inclined guiding surface 1221 is defined in an inner side of a free end (not numbered) of each locking arm portion 121. A protrusion portion 1223 is formed on the inner side of the free end of the corresponding locking arm portion 121 and arranged proximate to the guiding surface 1221, with a recessing area 122 formed between the protrusion portion 1223 and the vertical wall 120. Two cutouts 112 are respectively defined in the lateral sides of the base portion 11 and disposed behind the retaining portions 12.

The first terminal 2 includes an H-shaped retention portion 21 with two position cavities (not numbered) recessed inwardly from a top and a bottom edge thereof and spaced apart from one another by a neck part (not numbered), a blade-shaped mating portion 25 extending forwardly from a front edge of the retention portion 21, and a curved shaped tail portion 23 extending rearward from a rear edge of the retention portion 21. The retention portion 21 further has two first extension portions 22 and two second extension portions 24 projecting beyond the top surface and the bottom surface thereof, such that the retention portion 21 is broader than the other part of the first terminal 2. An up section of the first extension portion 22 is longer than a lower section of the other first extension portion 22 (FIG. 4).

Figure 4:
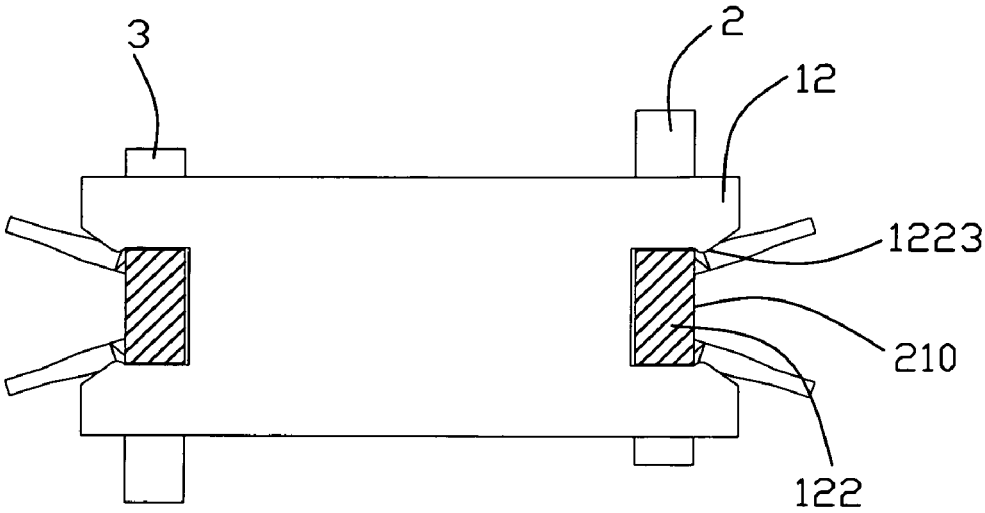
FIG. 4 is a cross-section view of FIG. 2 taken along line 4-4.

The second terminal 3 is similar to the first terminal 2, except that an up section of the first extension portion 22 is shorter than a lower section of the other first extension portion 22 (FIG. 4). The detailed description of the other identical parts are omitted hereby.

When assembly, the first terminal 2 is firstly mounted to a left side of the main portion 1, with the locking arm portions 121 extending into the position cavities of the retention portion 21, the neck part of the retention portion 21 is located in the recessing areas 122 and sandwiched between the locking arm portions 121. The inclined guiding surfaces 1221 of the locking arm portions 121 facilitate the first terminal 2 assembled to the main portion 1 easily. The tail portion 23 is partially accommodated in the corresponding cutout 112 of the base portion 11. The second terminal 3 is mounted to the right side of the main portion 1 with the same manner as the first terminal 2 assembled thereto, and detailed description is omitted hereby. Wires (not shown) are respectively soldered to the tail portions 23 of the first terminal 2 and second terminal 3. A cover (not shown) is molded over the main portion 1 and the retention potions 21 of the first terminal 2 and the second terminal 3. The cutouts 112 and the first and second extension portions 22, 24 are enclosed within the cover, therefore the terminal module and the cover may be combined together more reliably.

It will be understood that the invention may be embodied in other specific forms without departing from the spirit or central characteristics thereof.

The present examples and embodiments, therefore, are to be considered in all respects as illustrative and not restrictive, and the invention is not to be limited to the details given herein.

The invention claimed is:

1. A terminal module, comprising:

at least two terminals for transmitting electrical power, each terminal having a retention portion defining two positioning cavities therein, a mating portion extending forward from the retention portion and a tail portion extending rearward from the retention portion; and an insulative main portion including a base portion and two retaining portions laterally extending outward from the base portion, each retaining portion having two locking arm portions spaced apart from one another and two protrusions formed on inner sides of free ends of the locking arms, respectively, the two protrusions disposed adjacent to each other and locked into the two positioning cavities of the retention portion of the corresponding terminal;

the retaining portion of the insulative housing laterally projecting beyond an outer side of the retention portion of the terminal, while the retention portion of the terminal longer than the retaining portion of the insulative housing along a up-to-down direction; wherein two cutouts are defined in lateral sides of the base portion and located behind the two retaining portions of the insulative main portion; wherein the tail portions of the terminals are partially disposed in the two cutouts, respectively.

2. The terminal module as recited in claim 1, wherein the retention portion is substantially H-shaped, with a neck portion arranged between the two positioning cavities.

3. The terminal module as recited in claim 2, wherein the neck portion of the retention portion is held by the two locking arm portions of the corresponding retaining portion.

4. The terminal module as recited in claim 1, wherein an inclined guiding surface is defined on an inner side of a free end of the locking arm portion.

5. A terminal module, comprising:

a first and second terminals, each terminal having a substantially H-shaped retention portion, a mating portion extending forward from the retention portion and a tail portion extending rearward from the retention portion;

an insulative main portion including a base portion and two retaining portions laterally extending outward from the base portion, each retaining portion having two locking arm portions spaced apart from one another and two protrusion portions formed on inner sides of free ends of the locking arms, respectively, the two protrusion portions disposed adjacent to each other; and said locking arm portions inserted into the corresponding retention portion, with the two protrusion portions thereon latching with an exterior surface of the retention portion: wherein two cutouts are defined in lateral sides of the base portion and located behind the two retaining portions of the insulative main portion; wherein the tail portions of the terminals are partially disposed in the two cutouts, respectively.

6. The terminal module as recited in claim 5, wherein an inclined guiding surface formed on an inner side of the free end of each locking arm portion.

7. The terminal module as recited in claim 5, wherein a first and a second extension portions of the retention portions of the first and second terminals respectively project beyond a top and a bottom edges of the retention portion.

8. The terminal module as recited in claim 7, wherein the locking arm portions are sandwiched between the first and the second extension portions.

9. The terminal module as recited in claim 7, wherein an upper section of the first extension portion of the first terminal is longer than an upper section of the first extension portion of the second terminal.

10. The terminal module as recited in claim 9, wherein a lower section of the first extension portion of the first terminal is shorter than a lower section of the first extension portion of the second terminal.

11. The terminal module as recited in claim 7, wherein the first and the second extension portion extending beyond a top and a bottom surfaces of the insulative main portion.

12. A terminal module comprising:

an insulative block defining a pair of U-shaped retention section on two opposite lateral sides thereof; and a pair of terminals each defining an H-shaped retention portion; wherein the U-shaped retention section lying in a first plane is engaged with the corresponding H-shaped retention portion lying in a second plane which is perpendicular to said first plane; wherein said U-shaped retention section defines a wall extending along a first direction, and a pair of locking arms extending along a second direction perpendicular to said first direction and located at two opposite ends of the wall, said locking arms defining respectively a pair of protrusion portions at corresponding free ends and toward each other in said first direction; wherein a recessing area is defined by the pair of locking arms and the wall and is essentially formed between the pair of protruding portions and the wall in the second direction; wherein the recessing area defines a rectangular configuration having a long side along the first direction and a short side along the second direction so as to allow the corresponding terminal to be assembled thereto along a thickness direction of said H-shaped retention portion which is same with said second direction; wherein said insulative block further includes a pair of concave cutouts behind said retention section, and each of said terminal further includes a V-shaped wire connection portion behind the retention portion to be received in the corresponding concave cutout.

13. The terminal module as claimed in claim 12, wherein said insulative block further defines a convex rear end though which the pair of concave cutouts extend rearward.

14. The terminal module as claimed in claim 12, wherein the V-shaped wire connection portions of the pair of terminals open along opposite direction.

* * * * *